US005838805A

United States Patent [19]

Warnaka et al.

[11] Patent Number: 5,838,805

[45] Date of Patent: Nov. 17, 1998

[54] PIEZOELECTRIC TRANSDUCERS

[75] Inventors: Mark E. Warnaka, Howard; Glenn E. Warnaka, State College, both of Pa.

[73] Assignee: Noise Cancellation Technologies, Inc., Linthicum, Md.

[21] Appl. No.: 554,049

[22] Filed: Nov. 6, 1995

[51] Int. Cl.[6] ..... H04R 25/00

[52] U.S. Cl. ..... 381/190; 381/191; 310/322; 310/324

[58] Field of Search ..... 381/173, 190, 381/191, 188, 182, 184; 310/323, 324

[56] References Cited

U.S. PATENT DOCUMENTS

| | | | |
|---|---|---|---|
| 3,423,543 | 1/1969 | Kompanek | 179/110 |
| 4,401,857 | 8/1983 | Morikawa | 381/190 |
| 4,439,640 | 3/1984 | Takaya . | |
| 4,449,019 | 5/1984 | Kakehi et al. | 381/191 |
| 4,654,554 | 3/1987 | Kishi | 381/190 |
| 4,779,246 | 10/1988 | Dietzsch et al. | 381/190 |
| 4,807,294 | 2/1989 | Iwata et al. | 381/190 |
| 4,885,781 | 12/1989 | Seidel | 381/190 |
| 4,969,197 | 11/1990 | Takaya | 361/190 |
| 4,979,219 | 12/1990 | Lin | 381/190 |
| 5,031,222 | 7/1991 | Takaya | 381/190 |
| 5,126,615 | 6/1992 | Takeuchi et al. | 310/324 |
| 5,196,755 | 3/1993 | Shields | 381/190 |
| 5,291,460 | 3/1994 | Harada et al. | 381/190 |
| 5,386,479 | 1/1995 | Hersh | 381/190 |
| 5,684,884 | 11/1997 | Nakaya et al. | 381/190 |

FOREIGN PATENT DOCUMENTS

| | | | |
|---|---|---|---|
| 0123299 | 7/1983 | Japan | 381/190 |
| 0034800 | 2/1984 | Japan | 381/190 |
| 0113799 | 4/1990 | Japan | 381/190 |

*Primary Examiner*—Curtis A. Kuntz
*Assistant Examiner*—Rexford N. Barnie

[57] ABSTRACT

The invention consists of an integral transducer for a sound radiating diaphragm which may consist of a piezoelectric material, a substrate or a spacer and electrical connector means for a wire harness or other electrical connection. The substrate is used to enhance the motion of the piezoelectric element by spacing the piezoelectric element from the diaphragm. The substrate is larger in area than the piezoelectric element. The transducer system acts to impart motion to a diaphragm. The transducer comprises a piezoelectric element subject to displacement by applied electric potential that has a top side, an under side and an outer perimeter; a substrate that is joined to the underside of the piezoelectric element, and means to apply electric potential to the piezoelectric element.

24 Claims, 3 Drawing Sheets

FIG.1
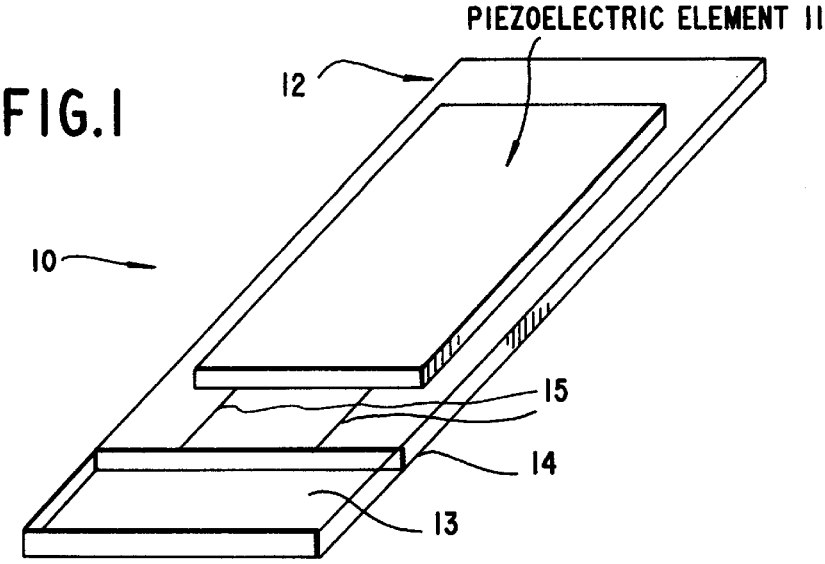
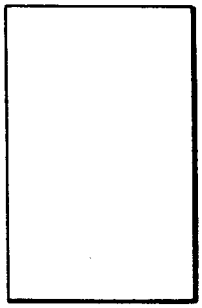
FIG.2A
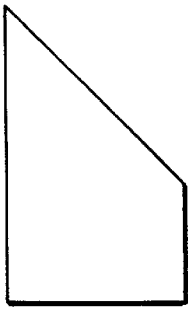
FIG.2B
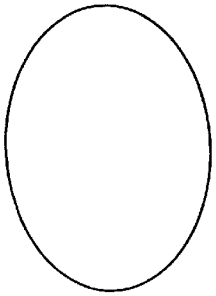
FIG.2C
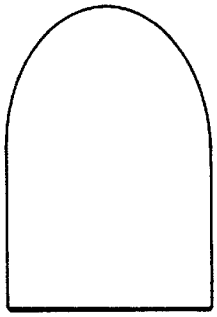
FIG.2D
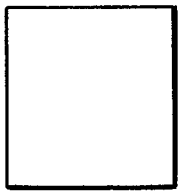
FIG.2E

PIEZOELECTRIC TRANSDUCERS

BACKGROUND ART

Loudspeakers employing a piezoelectric transducer capable of propagating surface acoustic waves to drive a diaphragm have been proposed as an alternative to moving coil loudspeakers. Such a device was described by Martin in U.S. Pat. No. 4,368,401 and later Takaya in U.S. Pat. No. 4,439,640. Both inventions dealt with attaching a disc shaped piezo to a diaphragm. Martin's device used a thick glue layer (10 to 50% of the carrier plate thickness) between a carrier plate and the piezo ceramic. The adhesive layer served to attenuate resonance. Any displacement in the piezoelectric is directly related to the applied electrical potential.

One disadvantage to utilizing transducers employing a piezoelectric element is that such materials are very costly and that a substantial expense would be involved to utilize a sufficiently sized piezo electric material to drive large diaphragms. Another disadvantage is that piezoelectric materials are as a rule comparatively brittle and do not deform well. Consequently, if one attempts to have piezoelectric materials conform to the curvature of an irregularly shaped diaphragm they may shatter or break, resulting in necessary expense.

Therefore it would be advantageous to attempt to reduce the cost of using piezoelectric elements in a transducer and to adapt them is such a way to a diaphragm so as to reduce the possibility of having the piezo be damaged.

BRIEF DESCRIPTION OF THE INVENTION

The present invention involves a transducer which is utilized to drive a diaphragm, in particular a comparatively large diaphragm. The transducer is comprised of a piezoelectric layer, (or a layer of some other material covered with a layer of piezo-electric material) capable of propagating flexural acoustic waves, which piezoelectric material typically is a flat layer placed on top of a substrate layer which has essentially the same degree of rigidity (as measured by its Young's modulus and thickness) as the piezoelectric electric material, but has more rigidity than the diaphragm material so that when the substrate material is distorted by the motion of the piezoelectric material the diaphragm will move accordingly. In this regard, the thickness of the substrate may be optimized to the properties of the piezoelectric material. The substrate will be larger in surface area than the piezoelectric element in order to impart motion to a larger area of the diaphragm. The invention also comprises utilizing multiple transducers on a single diaphragm to extend the frequency range. In this case larger transducers would be used to produce low frequencies and smaller transducers would be used to produce higher frequencies. The use of multiple transducers serves to increase the motion imparted to the diaphragm and, hence, the volume or loudness of the sound.

DESCRIPTION OF THE DRAWINGS

FIG. 1 illustrates one embodiment of a transducer according to the present invention.

FIG. 2 illustrates possible shapes of piezoelectric elements utilized in the present invention.

DETAILED DESCRIPTION OF THE INVENTION

Figure 3:
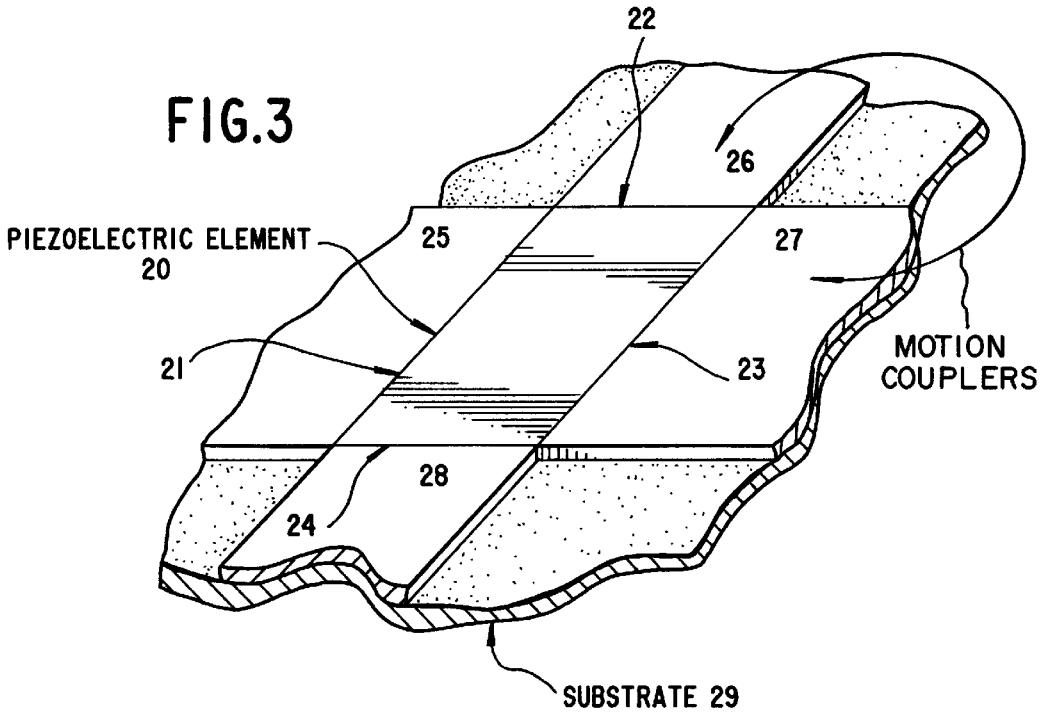
FIG. 3 illustrates another embodiment of a transducer of the present invention in which the piezoelectric element is utilized in conjunction with motion couplers.

FIG. 1 illustrates one embodiment of transducer design 10 of the present invention. A piezoelectric element 11 is placed on top of a substrate 12 which has a larger surface area than the piezoelectric layer. The piezoelectric layer may be bonded to the substrate by any suitable material.

The substrate will have a larger surface area than the piezoelectric element in order to impart motion to a larger area of the diaphragm than if the substrate alone was attached to the diaphragm. This will result in cost savings since lesser amounts of the costly piezoelectric material need be utilized. The substrate will have a rigidity no greater than the rigidity of the piezoelectric element but greater than the rigidity of a diaphragm to which the substrate will be attached.

Many materials may be advantageously be used for the substrate. These materials include steel, aluminum, brass, copper, and other metals, plastics, composite materials, etc. Brass is a preferred material for the substrate because of its low cost, environmental resistance, ease of bondability and because its Young's modulus of elasticity is similar to that of certain piezoelectric materials, such as PZT (lead-zirconitanate). The transducer will also include means to apply electric potential to the piezoelectric element, which in the depicted embodiment comprises a connector 13 for a wire harness which is optionally attached to and extends from the edge 14 of substrate 12. FIG. 1 also illustrates electrical leads 15 from the piezoelectric element 11 to connector 13.

Substrate 12 will be attached directly, on the side opposite to the side that is attached the piezo element, to a diaphragm (not shown). The substrate and perhaps the piezoelectric element may be preformed, or otherwise configured, to conform to the curvature, or other shape, of the sound radiating diaphragm to which the substrate is attached. In a preferred embodiment, for maximum efficiency and minimum distortion both the mechanical and electrical impedances of the transducer should be matched. That is, the mechanical impedance of the transducer should be matched to that of the sound radiating diaphragm while the electrical impedance of the amplifier that drives the transducer should be matched to that of the transducer when it is radiating sound. In another embodiment, the transducer may also be covered with a conformal coating to provided electrical insulation and environmental resistance. In addition, the piezo element may consist of two or more layers arranged on top of one another and electrically connected in an alternating fashion to enhance the motion of the piezoelectric element.

FIG. 2 illustrates examples of possible shapes for the piezoelectric element. The element may be made in a variety of shapes, such as square, rectangular and round. Irregular shapes may also be used to minimize resonances on the transducer itself and/or to extend the frequency range. To accomplish the latter goal, elliptical, semi-elliptical, truncated rectangular and truncated square shapes, etc. may be used.

FIG. 3 illustrates another embodiment of a transducer of the present invention in which piezoelectric element 20, which in the illustration has a rectangular shape (although any other shaped piezoelectric element can be utilized in this embodiment) is coupled on, most preferably, all its sides 21,22, 23 and 24 with motion couplers 25, 26, 27, 28 to further ensure the coupling of the motion of the piezoelectric element to substrate 29 by provide a coupling transition to the substrate, to which piezoelement 20 is bonded and positioned on top of, in all directions of movement. If desired, the motion couplers may be attached only to certain sides of the piezoelectric element. By providing a coupling transition to the substrate it will be further insured that the motion of the piezoelectric element will be coupled to the sound radiating diaphragm (not shown). This is accomplished by tightly coupling, preferably, both the transverse and lateral motions of the piezoelectric element, first to the motion couplers, with the end result that the motion will thereafter be passed through the substrate to the sound radiating diaphragm. The motion couplers will also be attached to the substrate. It has been discovered that the use of the motion couplers will increase the loudness of the sound produced by the sound radiating diaphragm and extend the bass sound produced to lower frequencies.

Figure 4:
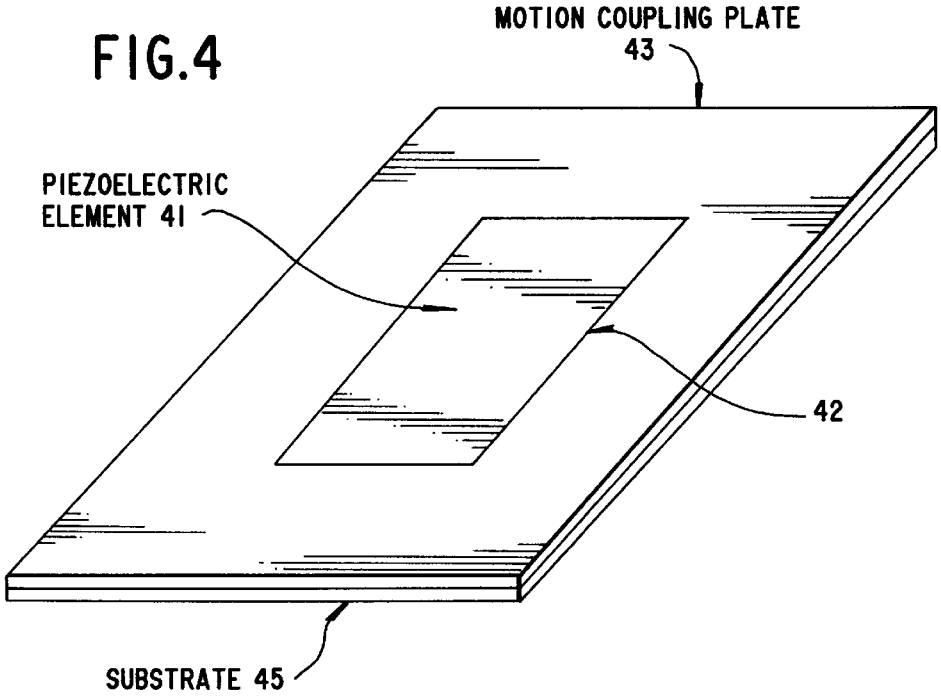
FIG. 4 illustrates a further embodiment of a transducer of the present invention in which the piezoelectric element is shown as being utilized in conjunction with motion couplers in another manner.

FIG. 4 illustrates a further embodiment of a transducer of the present invention in which the piezoelectric element 41 is shown as being utilized in conjunction with motion couplers in another manner. In this embodiment, the outer perimeter 42 of piezoelectric element 41 is completely surrounded by a single motion coupling plate 43. Motion coupling plate 43 has a hole, which in the depicted embodiment is in its center, which is cut out in order to accommodate the presence of piezoelectric element 41. Piezoelectric element 41 must fit the hole in motion coupling plate 43 very snugly so that the piezoelectric element 41 will be bonded at its edges 42 to the edges of the hole in motion coupling plate 43. In general, motion coupling plate 43 should be of the same thickness as the piezoelectric element 41. Piezoelectric element 41 and motion coupling plate 43 are both bonded to the underlying substrate 45. The material of the motion coupling plate 43 and the substrate 45 may be of the same material or different materials such that the motion of the piezoelectric element 41 is not substantially restricted. One advantage of this concept is that less parts are involved and hence the transducer is more readily adaptable to being mass produced.

Figure 5:
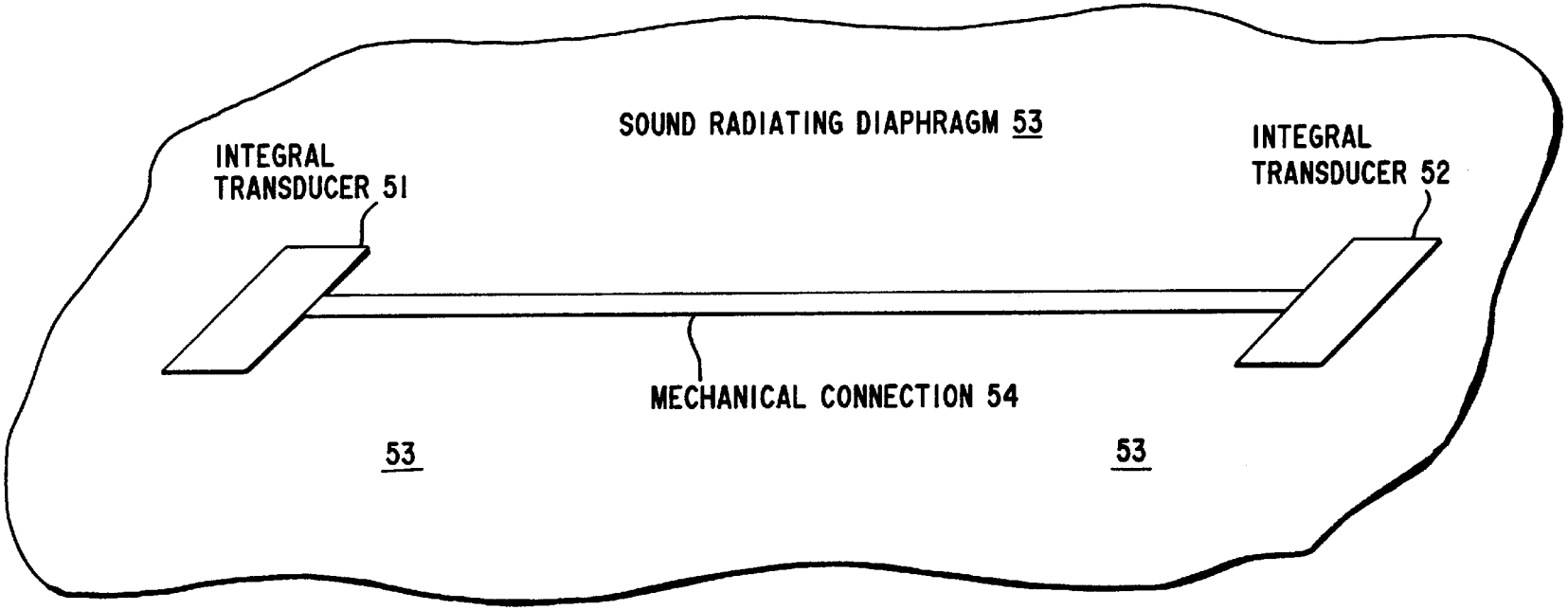
FIG. 5 illustrates another embodiment of the present invention in which two transducers are connected to each other via a mechanical connection.

The transducer of the present invention will of course, when attached to a diaphragm, form a loudspeaker. FIG. 5 illustrates another embodiment of the present invention in which more than one integral transducer, in this case a pair of transducers 51 and 52, which are constructed in accordance with the present invention, are attached to the same diaphragm 53. It has been discovered that using more than one transducer in conjunction with the same diaphragm will create a stereo sound image, and will also increase the loudness and/or extend the frequency range. The preferred distance by which the transducers should be separated will depend on the size, material of construction and configuration of the speaker. FIG. 5 illustrates a further embodiment of the present invention, in which transducers 51 and 52 are connected to each other via a mechanical connector 54. It has been shown that, when such a mechanical connection is employed, the quality of the stereo effect produced will be enhanced and the overall quality and volume of the sound will be improved. In one embodiment tested, the mechanical connector was a metal beam of 0.02 inch thick sheet steel and was one inch wide. The length of the mechanical connector should be such that some outward force is exerted on the integral transducers. Of course, other materials of construction and/or other dimensions of mechanical connector 54 may be utilized. In another embodiment, when more than one transducer is utilized in conjunction with a particular diaphragm, the mechanical connector may be an integral part of the transducers. For example, the substrate may be made continuous between the transducers to form the mechanical connection. Alternatively, the motion couplers described above may be formed into an integral mechanical connection. For larger diaphragms, more than two transducers may be so utilized. When more than two transducers are utilized it is preferred that they be utilized in pairs, preferably with the transducers in each pair being connected to each other by a mechanical connector.

As indicated, the piezoelectric material typically is in the form of a plate that is placed on top of a substrate plate which has essentially the same degree of rigidity (as measured by its Young's modulus and thickness) as the piezoelectric electric material. In this regard, attention should be paid to the extension stiffness (K), represented by K=EA/L=wt/1, wherein E= Young's modulus of elasticity; A=cross sectional area of the plate; 1= length of the plate; w=width of the plate; t=thickness of the plate. For a unit length and width of a plate, the extensional stiffness becomes K=Et.

Therefore, there are two parameters, E=Young's modulus of elasticity; and t=thickness of the layer, that may be used to match the stiffness or rigidity of the piezoelectric material with those of the substrate and motion coupler layers. To couple the motion of the piezoelectric material to the substrate and motion coupler layers the stiffness of all layers (or just the piezoelectric element and substrate when motion couplers are not utilized) should be substantially the same and certainly with an order of magnitude. That is, the extensional stiffness of the piezoelectric material under electric stimulation should be substantially equal to the extensional stiffness of the substrate and (when utilized) the extensional stiffness of the motion couplers.

The forgoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A transducer system for imparting motion to a sound radiating diaphragm having a certain mechanical impedance comprising:

a piezoelectric element subject to displacement by applied electric potential and having a top side, an under side and an outer perimeter;

a substrate for imparting motion from said piezoelectric element to a sound radiating diaphragm, said substrate having an upper and lower side, with the upper side of the substrate being directly joined to the underside of the piezoelectric element, said substrate having a larger surface area than the piezoelectric element and having substantially the same rigidity as the piezoelectric element but a greater rigidity than the diaphragm to which the lower side of the substrate will be attached; and, means to apply electric potential to the piezoelectric element, wherein the transducer system has a mechanical impedance that is matched to the mechanical impedance of the sound radiating diaphragm.

2. The transducer of claim 1 wherein the substrate is brass.

3. The transducer of claim 1 further comprising at least one motion coupler having an upper side and an under side and an outer edge, which motion couple is attached by at least a portion of its outer edge to at least a portion of the outer perimeter of the piezoelectric element and on its underside to the upper side of the substrate.

4. The transducer of claim 1 wherein the at least one motion coupler is brass.

5. The transducer of claim 3 wherein the at least one motion coupler is in one piece which completely surrounds the piezoelectric element.

6. The transducer of claim 5 wherein the one motion coupler is brass.

7. The transducer of claim 3 wherein the at least one motion coupler is comprised of the same material as the substrate.

8. The transducer of claim 6 wherein both the at least one motion coupler and the substrate are brass.

9. A loudspeaker system comprising:

a piezoelectric element subject to displacement by applied electric potential and having a top side, an under side and an outer perimeter;

a substrate for imparting motion from said piezoelectric element to a sound radiating diaphragm, said substrate having an upper and lower side, with the upper side of the substrate being directly joined to the underside of the piezoelectric element, said substrate having a larger surface area than the piezoelectric element and having substantially the same rigidity as the piezoelectric element but a greater rigidity than that of the diaphragm to which the lower side of the substrate will be attached; means to apply electric potential to the piezoelectric element, wherein said piezoelectric element, substrate, and means to apply electric potential in combination form a transducer; and a sound radiating diaphragm that is driven by the transducer, said diaphragm having a certain mechanical impedance and an under side and a top side, with the under side of the substrate being attached to said top side of the diaphragm, wherein the transducer has a mechanical impedance that is matched to the mechanical impedance of the sound radiating diaphragm.

10. The loudspeaker of claim 9 wherein more than two transducers are attached to the diaphragm.

11. The loudspeaker of claim 10 wherein the more than two transducers are multiple pairs of transducers.

12. The loudspeaker of claim 11 wherein the transducers in each pair are attached to each other by a mechanical connector.

13. The loudspeaker of claim 12 wherein the mechanical connector is an integral part of the transducers.

14. The loudspeaker of claim 13 wherein the mechanical connector is formed from the substrate.

15. The loudspeaker of claim 13 further comprising at least one motion coupler having an upper side and an under side and an outer edge, which motion couple is attached by at least a portion of its outer edge to at least a portion of the outer perimeter of the piezoelectric element and on its underside to the upper side of the substrate.

16. The loudspeaker of claim 15 wherein the mechanical connector is formed from the at least one motion couplers.

17. The loudspeaker of claim 9 wherein two transducers are attached to the diaphragm.

18. The loudspeaker of claim 17 wherein the two transducers are attached to each other by a mechanical connector.

19. The loudspeaker of claim 18 wherein the mechanical connector is an integral part of the transducers.

20. The loudspeaker of claim 19 wherein the mechanical connector is formed from the substrate.

21. The loudspeaker of claim 20 wherein the mechanical connector and the substrate are brass.

22. The loudspeaker of claim 19 further comprising at least one motion coupler having an upper side and an under side and an outer edge, which motion couple is attached by at least a portion of its outer edge to at least a portion of the outer perimeter of the piezoelectric element and on its underside to the upper side of the substrate.

23. The loudspeaker of claim 22 wherein the mechanical connector is formed from the at least one motion coupler.

24. The loudspeaker of claim 22 wherein the at least one motion coupler is brass.

* * * * *